US005744440A

United States Patent [19]

Liu

[11] Patent Number: 5,744,440

[45] Date of Patent: Apr. 28, 1998

[54] HARD SURFACE CLEANING COMPOSITIONS INCLUDING A VERY SLIGHTLY WATER-SOLUBLE ORGANIC SOLVENT

[75] Inventor: Augustine Liu, Bloomington, Minn.

[73] Assignee: Minnesota Mining and Manufacturing Company, St. Paul, Minn.

[21] Appl. No.: 597,681

[22] Filed: Feb. 6, 1996

Related U.S. Application Data

[62] Division of Ser. No. 347,589, Nov. 30, 1994, Pat. No. 5,503,778, which is a continuation of Ser. No. 39,642, Mar. 30, 1993, abandoned.

[51] Int. Cl.[6] ..... C11D 3/28; C11D 1/75; C11D 3/43

[52] U.S. Cl. ..... 510/362; 134/6; 510/238; 510/433; 510/500; 510/503

[58] Field of Search ..... 510/362, 238, 510/433, 500, 503; 134/6

[56] References Cited

U.S. PATENT DOCUMENTS

| | | | |
|---|---|---|---|
| T903,009 | 10/1972 | Katstra | 510/495 |
| 2,710,843 | 6/1955 | Stebleton | 134/29 |
| 2,901,433 | 8/1959 | Spring | 510/437 |
| 2,929,789 | 3/1960 | Pickett et al. | 510/185 |
| 2,958,593 | 11/1960 | Hoover et al. | 51/295 |
| 3,202,714 | 8/1965 | Zimmerer et al. | 564/297 |
| 3,367,878 | 2/1968 | Mankowich | 510/245 |
| 3,463,735 | 8/1969 | Stonebraker et al. | 510/182 |
| 3,553,144 | 1/1971 | Murphy | 510/203 |
| 3,615,827 | 10/1971 | Murphy | 134/38 |
| 3,634,338 | 1/1972 | Laugle et al. | 510/254 |
| 3,664,962 | 5/1972 | Kelly et al. | 510/174 |
| 3,696,043 | 10/1972 | Labarge et al. | 510/182 |
| 3,806,460 | 4/1974 | Mukai et al. | 510/197 |
| 3,872,021 | 3/1975 | McKnight | 510/282 |
| 3,882,038 | 5/1975 | Clayton et al. | 510/421 |
| 3,917,850 | 11/1975 | Boucher | 514/705 |
| 3,928,249 | 12/1975 | Nunziata et al. | 510/237 |
| 3,939,090 | 2/1976 | Zmoda | 510/182 |
| 3,943,234 | 3/1976 | Roggenkamp | 514/724 |
| 3,948,819 | 4/1976 | Wilde | 510/254 |
| 4,013,607 | 3/1977 | Dwyer et al. | 524/428 |
| 4,017,409 | 4/1977 | Demessemaekers et al. | 510/429 |
| 4,040,977 | 8/1977 | Eggensperger et al. | 252/401 |
| 4,144,201 | 3/1979 | Winterbotham et al. | 510/423 |
| 4,174,304 | 11/1979 | Flanagan | 510/182 |
| 4,175,062 | 11/1979 | Disch et al. | 510/424 |
| 4,203,872 | 5/1980 | Flanagan | 252/312 |
| 4,225,471 | 9/1980 | Claus et al. | 510/338 |
| 4,235,734 | 11/1980 | Scherubel | 510/269 |
| 4,240,919 | 12/1980 | Chapman | 510/369 |
| 4,254,104 | 3/1981 | Suzuki | 514/785 |
| 4,264,466 | 4/1981 | Carleton et al. | 510/304 |
| 4,297,251 | 10/1981 | Bernardino | 134/25.2 |
| 4,348,292 | 9/1982 | Ginn | 510/406 |
| 4,414,128 | 11/1983 | Goffinett | 510/405 |
| 4,460,374 | 7/1984 | Abel et al. | 8/501 |
| 4,501,680 | 2/1985 | Aszman et al. | 510/238 |
| 4,552,685 | 11/1985 | Kernstock et al. | 252/355 |
| 4,561,991 | 12/1985 | Herbots et al. | 510/281 |
| 4,587,030 | 5/1986 | Casey | 510/406 |
| 4,606,842 | 8/1986 | Keyes et al. | 510/182 |
| 4,606,850 | 8/1986 | Malik | 510/420 |
| 4,673,523 | 6/1987 | Smith et al. | 15/104.93 |
| 4,726,915 | 2/1988 | Verdicchio | 510/469 |
| 4,732,695 | 3/1988 | Francisco | 510/212 |
| 4,741,863 | 5/1988 | Yamamoto et al. | 510/245 |
| 4,749,508 | 6/1988 | Cockrell, Jr. et al. | 510/201 |
| 4,749,509 | 6/1988 | Kacher | 510/427 |
| 4,758,377 | 7/1988 | Iding et al. | 510/398 |

(List continued on next page.)

FOREIGN PATENT DOCUMENTS

| | | |
|---|---|---|
| 0 130 786 | 1/1985 | European Pat. Off. . |
| 2 571 279 | 4/1986 | France . |
| A2 582 546 | 12/1986 | France . |
| 52-77111 | 6/1977 | Japan . |
| 54-14406 | 2/1979 | Japan . |
| 56-22397 | 3/1981 | Japan . |
| 57-28199 | 2/1982 | Japan . |
| 57-83598 | 5/1982 | Japan . |
| 58-185700 | 10/1983 | Japan . |
| 59-70652 | 4/1984 | Japan . |
| 782 898 | 9/1957 | United Kingdom . |
| 1 602 234 | 11/1981 | United Kingdom . |
| 2 166 153 | 4/1986 | United Kingdom . |
| WO 91/00337 | 1/1991 | WIPO . |
| WO 94/22965 | 10/1994 | WIPO . |

OTHER PUBLICATIONS

"Ethers for Household and Institutional Products", 1976.

International Specialty Products product literature "Surfadone LP Specialty Solvents and Surfactants", 1992.

ARCO Chemical Company trade literature "Introducing ARCOSOLV PTO Solvent", Sep. 1992.

"Solvent Formulations From Eastman Chemicals", Sep. 1983.

Exxon Chemical Company product literature "AO–14–2", Dec. 4, 1991.

Exxon Chemical Company product literature "Non–Butyl Cleaners", Dec. 1980.

Exxon Chemical Company "1992 Formulary", Mar. 8, 1989.

Exxon Chemical Company product literature "Exxal 8 Alcohol", Sep. 1988.

Propylene–Based Glycol Ethers, by Nancy Morris and James Twining. "Household and Personal Products Industry," May 1982, pp. 48–54.

CRC Handbook of Chemical & Physics, 60th Ed., pp. C80, C86, C461, & C479 and The Merck Index, Ninth Ed., Merck & Co., Inc. pp. 792 and 1016.

*Primary Examiner*—Ardith Hertzog

*Attorney, Agent, or Firm*—Daniel R. Pastirik

[57] ABSTRACT

Cleaning compositions are presented which surprising exhibit increased cleaning performance as the amount of solubilizing coupler is increased beyond that necessary to fully solubilize a very slightly water-soluble organic solvent component. Methods of use of the compositions to remove hydrophobic soils and soap scum are also described.

16 Claims, No Drawings

U.S. PATENT DOCUMENTS

| | | | |
|---|---|---|---|
| 4,767,563 | 8/1988 | Buzzaccarini | 510/397 |
| 4,769,172 | 9/1988 | Siklosi | 510/407 |
| 4,776,974 | 10/1988 | Stanton et al. | 514/557 |
| 4,790,951 | 12/1988 | Wittpenn, Jr. et al. | 510/365 |
| 4,814,109 | 3/1989 | Frieser et al. | 134/42 |
| 4,857,114 | 8/1989 | Brumbaugh et al. | 134/42 |
| 4,863,629 | 9/1989 | Osberghaus et al. | 510/421 |
| 4,891,147 | 1/1990 | Gray et al. | 510/303 |
| 4,909,962 | 3/1990 | Clark | 510/284 |
| 4,927,556 | 5/1990 | Pokorny | 510/206 |
| 5,019,289 | 5/1991 | Gray et al. | 510/303 |
| 5,080,822 | 1/1992 | VanEenam | 510/365 |
| 5,080,831 | 1/1992 | VanEenam | 510/365 |
| 5,093,031 | 3/1992 | Login et al. | 252/357 |
| 5,102,573 | 4/1992 | Han et al. | 134/19 |
| 5,126,068 | 6/1992 | Burke et al. | 510/421 |
| 5,158,710 | 10/1992 | VanEenam | 510/264 |
| 5,435,934 | 7/1995 | Jon et al. | 8/137 |
| 5,503,778 | 4/1996 | Liu et al. | 134/6 |

HARD SURFACE CLEANING COMPOSITIONS INCLUDING A VERY SLIGHTLY WATER-SOLUBLE ORGANIC SOLVENT

This is a division of application Ser. No. 08/347,589 filed Nov. 30, 1994, now U.S. Pat. No. 5,503,778, which is a continuation of Ser. No. 08/039,642 filed May 30, 1993, now abandoned.

BACKGROUND OF THE INVENTION

1. Brief Description of the Invention

The present invention concerns cleaning compositions which surprisingly exhibit greater cleaning performance when a solubilizing coupler concentration is increased beyond that necessary to completely solubilize an organic solvent. A method of cleaning hard surfaces using the compositions of the invention is also described.

2. Related Art

Chemical cleaners are a significant portion of the industrial cleaning market. A chemical cleaner is typically aqueous and comprises an organic solvent to solubilize various soils, a surfactant which serves as a wetting agent, and a builder which serves to chelate ions present in water, such as magnesium and calcium. The types and ratios of these ingredients can vary considerably depending on the types of soils to be cleaned and the performance desired. It is common that all components are water soluble. In some instances, however, particularly with the solvent ingredient, the water solubility can be negligible. In these cases, components commonly called "couplers" or "hydrotropes" are used to increase the apparent water solubility of the organic solvent in the cleaning composition. The amount of coupler required depends on the type of coupler, organic solvent, and the other components of the mixture.

It is typically preferred to use the minimum amount of coupler necessary to completely solubilize the solvent, as this tends to reduce the cost of the cleaning composition. Further, as noted in U.S. Pat. Nos. 5,080,822 and 5,080,831, in conventional compositions as the amount of coupler increases, the cleaning performance typically decreases.

SUMMARY OF THE INVENTION

In light of the state of the art it was surprising to the present inventors that the performance of the inventive cleaning compositions described herein actually improved in performance with increased coupler concentration.

One aspect of the present invention is a composition suitable for removing hydrophobic materials from surfaces, the composition comprising:

a) an organic solvent having a surface tension of no more than about 30 dynes/cm at 0.1 weight percent in water, and which is very slightly water-soluble;

b) an effective amount of a coupler; and c) a surfactant.

Preferably, the amount (weight) of coupler present is at least three times that required to completely solubilize the organic solvent. This is because, as shown in the examples, as the amount of coupler is increased beyond that amount very good cleaning results are obtained.

"Coupler" refers to a material which has the capability of increasing the phase-stability of the composition. The term is synomynous with "hydrotrope," a term frequently used in the art. As used in reference to the coupler, "effective amount" means the weight of coupler present is at least that amount required to completely solubilize the organic solvent present in the composition (as observed visually with no magnification).

Preferred couplers for use in the hydrophobic soil cleaning compositions of the invention include the combination of a low molecular weight alkanol amine having from about 2 to about 10 carbon atoms, such as monoethanolamine, triethanolamine, diethanolamine and the like, with a linear alkylbenzenesulfonate. "Low molecular weight" means molecular weights less than about 500. "Linear alkylbenzenesulfonate" includes sodium-dodecylbenzenesulfonate, dodecylbenzenesulfonic acid, and the like.

As used herein the term "very slightly water-soluble" means that the organic solvent has a water solubility ranging from about 0.01 weight percent to about 0.2 weight percent, more preferably ranging from about 0.1 to about 0.2 weight percent. Preferred organic solvents for use in the compositions of this aspect of the invention are N-alkyl pyrrolidones, wherein the alkyl group has from about 8 to about 12 carbon atoms, such as N-octyl pyrrolidone and the like.

The term "surfactant" means a substance which is able to reduce the surface tension of water. Preferred surfactants for use in the hydrophobic soil cleaning compositions of the invention are nonionic surfactants.

The weight ratio of active very slightly water-soluble organic solvent to active surfactant in the hydrophobic soil cleaning compositions of the invention (concentrates and diluted versions) preferably ranges from about 0.5:1.0 to about 1.5:1.0, more preferably ranging from about 0.8:1.0 to about 1.2:1.0, and most preferably is about 1.0:1.0.

The weight ratio of active low molecular weight alkanol amine to linear alkylbenzenesulfonate in the hydrophobic soil cleaning compositions of the invention (concentrates and diluted versions) preferably ranges from about 2.0:1.0 to about 1.0:1.0, more preferably ranging from about 1.7:1.0 to about 1.3:1.0, most preferably about 1.5:1.0.

Quite unexpectedly, the inventors have discovered that as the amount of coupler in ready-to-use ("RTU", i.e. diluted) compositions increases from about 0.2 to about 1.0 weight percent, the cleaning properties of the compositions of the first aspect of the invention improved dramatically, as evidenced by the examples herein.

A second aspect of the invention is a bath cleaner composition suitable for removing soap scum and mineral scale (sometimes referred to simply as "scale") as may be found in household and other bathrooms, kitchens, and the like. "Soap scum" is a term describing a composition typically comprising soap, and organic material such as sebum. "Mineral scale" refers to mineral deposits (calcium and magnesium) from "hard" water. Again, as with the compositions suitable for removing hydrophobic materials from surfaces, the inventors herein unexpectedly discovered that the soap scum removal rate was actually improved with increased coupler concentration, particularly above three times that required to completely solubilize the very slightly water-soluble organic material.

Compositions in accordance with the second aspect of the invention comprise:

a) an organic solvent having a surface tension of no more than about 30 dynes/cm at 0.1 weight percent in water, and which is very slightly water-soluble;

b) an effective amount of an amine oxide coupler;

c) an effective amount of a strong organic acid; and d) an effective amount of a weak organic acid.

As used in reference to the amine oxide coupler, "effective amount" means the weight of amine oxide coupler present is at least that amount required to completely solubilize the organic solvent present in the composition (as observed visually with no magnification). As with the hydrophobic soil removal compositions, the weight of coupler is preferably at least three times that weight required to completely solubilize the organic solvent.

The weak organic acid in the soap scum/mineral scale cleaning compositions of the present invention serves the function of being the primary dissolver of soap scale; thus, an effective amount is that amount which substantially completely dissolves the soap scale.

The weak organic acid component of the soap scum cleaning compositions may be selected from any one of a number of organic acids within the general formula $R^5COOH$, wherein $R^5$ may be selected from the group consisting of $C_1$–$C_5$ alkyl groups. One preferred weak organic acid is acetic acid. The weak organic acid should be capable of producing a pH in water ranging from about 5.0 to about 6.9.

The strong organic acid component serves secondarily as a dissolver of soap scale, and primarily as an odor control ingredient. Thus, an effective amount is that amount which the user desires to control odor to an acceptable degree. This amount will, of course, vary from user to user, but generally as the amount of strong acid increases, objectionable odors decrease.

The strong organic acid component of the compositions of this aspect of the invention may be liquid or solid at room temperature, provided they may be dissolved or dispersed in water at ready-to-use temperatures (i.e. typically about 20° C.). Preferred strong organic acids are those having the general formula $R^4COOH$, where $R^4$ is selected from the group consisting of $C_2$–$C_{20}$ hydroxyalkyl groups and alkyl groups, wherein "alkyl" includes straight and branched chain alkyls. Preferred within these strong organic acids are hydroxyacetic acid (glycolic acid). The strong organic acids should have the capability of producing a pH (negative logarithm of the hydrogen ion concentration) of no higher than about 5.0.

Preferred organic solvents for use in this aspect of the invention are those preferred for use in the hydrophobic soil removal compositions of the first aspect of the invention.

Preferred couplers for use in the soap scale cleaning compositions of the invention have been found to be amine oxide compounds represented by the general formula:

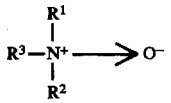

wherein $R^1$, $R^2$, and $R^3$ are defined as follows:

$R^1$ and $R^2$ may be the same or different $C_1$–$C_4$ alkyl or hydroxyalkyl groups, and $R^3$ may be any $C_8$–$C_{20}$ straight or branched chain alkyl or heteroalkyl group (preferably an ether).

The weight ratio of organic solvent to coupler in cleaning compositions within the invention preferably ranges from about 2:1 to about 5:1, more preferably ranging from about 2.5:1.0 to about 3.5:1.0, most preferably about 3.0:1.0. The weight ratio of organic solvent to weak acid preferably ranges from about 1.0:1.0 to about 2.0:1.0, more preferably ranging from about 1.2:1.0 to about 1.8:1.0, most preferably about 1.5:1.0. The weight ratio of strong organic acid to weak organic acid in weight percent typically ranges from about 1:1 to about 2:1, more preferably ranging from about 1:1 to about 1.5:1.

Both concentrated and ready-to-use compositions are considered within the invention. Concentrated cleaning compositions within the first aspect of the invention preferably contain no water. Concentrates of the invention are stable indefinitely under typical room temperature (25° C.) storage conditions. Concentrated versions of hydrophobic soil cleaning compositions within the invention may be diluted with up to about 150 parts water (i.e. 150 parts water to 1 part concentrate), more typically with about 100 parts water, on a weight basis. Concentrated versions of soap scale cleaning compositions within the invention may be diluted with up to about 50 parts water (i.e. 50 parts water to 1 part concentrate), more typically with about 40 parts water, also on a weight basis.

Another aspect of the invention is a method of removing hydrophobic materials from surfaces using the composition of the first aspect of the invention, while yet another aspect of the invention is a method of removing soap scale from hard surfaces using the composition of the second aspect of the invention.

Further aspects and advantages of the compositions and methods of the invention will become apparent from the description of preferred embodiments and examples which follow.

DESCRIPTION OF PREFERRED EMBODIMENTS

As used herein organic solvents useful in the compositions of the invention appear to give formulators of the compositions great latitude in adjusting the performance of the resulting ready-to-use compositions. The individual components of both the hydrophobic soil removing composition and the soap scale removing composition will now be described in greater detail.

Organic Solvents

The organic solvent used in all compositions of the invention serves to promote fast drying properties of the compositions, and to solubilize organic materials in hydrophobic soils, soap films, and scale.

Preferred organic solvents for use in the compositions of the first and second aspects of the invention have static surface tension of no more than about 30 dynes/cm, preferably no more than about 25 dynes/cm at 0.1 weight percent concentration in water, and are very slightly water-soluble. As used herein the term "very slightly water-soluble" means that the organic solvent has a water solubility ranging from about 0.01 weight percent to about 0.2 weight percent, more preferably ranging from about 0.1 to about 0.2 weight percent in water at 20° C.

One particularly preferred class of organic solvents meeting the above requirements are N-alkyl pyrrolidones, wherein the alkyl group has from about 8 to about 12 carbon atoms. Particularly preferred is the N-octyl pyrrolidone, available under the trade designation "Surfadone" LP-100 from International Specialty Products, Wayne, N.J. This particularly preferred pyrrolidone has a maximum solubility in water of about 0.124 weight percent, a minimum static surface tension of 28 dynes per centimeter, and a dynamic surface tension (at a surface age of one second) of 29 dynes per centimeter. N-octyl pyrrolidone has a Draves wetting time of four seconds at 0.1 weight percent solution in water. Another particularly preferred pyrrolidone is N-dodecyl pyrrolidone, wherein the alkyl group has 12 carbon atoms. This particular pyrrolidone has a maximum solubility in water of about 0.002 weight percent, a minimum static surface tension of about 26 dynes/cm, and a Draves wetting time of about 300 seconds at 0.1 weight percent solution in water.

Although the N-alkyl pyrrolidones are very slightly water-soluble, the addition of anionic and nonionic surfactants may increase their water solubility and wetting speed. Therefore, it is generally desirable to add nonionic surfactants and couplers to the compositions of the invention.

Couplers

As used herein, the term "coupler" is meant to describe a compound or combination of compounds, typically of low molecular weight (less than 500), which have as their primary function the ability to substantially completely, preferably completely solubilize the organic solvents useful in the compositions of the invention. Couplers may also have surfactant properties, however this is not their primary function. The term "hydrotrope" is also sometimes used to describe coupling chemicals, and the terms "coupler" and "hydrotrope" are used interchangeably herein.

In the hydrophobic soil removing compositions of the invention it is generally desirable to use a two component coupler system, such as the combination of a low molecular weight alkanol amine such as monoethanolamine and the like, and a linear alkylbenzenesulfonate or alkylbenzenesulfonic acid, such as dodecylbenzenesulfonic acid, or the sodium sulfonate thereof. The low molecular weight alkanol amine is preferably used in molar excess over the linear alkylbenzenesulfonate or alkylbenzenesulfonic acid because it is generally desirable for these compositions to be basic in pH, preferably having a pH ranging from about 8 to about 11 for RTU, from about 8 to 12 for concentrated versions.

In the soap scale removal compositions of the second aspect of the invention, the preferred couplers are single component, more preferably an amine oxide such as that known under the trade designation "AMMONYX LO", available from Stepan Chemicals Company, Northfield, Ill. This particular amine oxide has the following general structure:

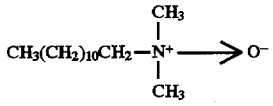

Other amine oxides which may be used as couplers in the soap scale cleaning compositions of the invention include those known under the trade designation "AO-14-2"", which is an ether amine oxide (dihydroxyethyl isododecyloxypropyl amine oxide). The amount of amine oxide coupler in the concentrated soap scale cleaning compositions typically and preferably ranges from about 8 to about 20 weight percent active, more preferably ranging from about 8 to about 15 weight percent active. Surprisingly, as with the inventive hydrophobic soil removing compositions, as the amount of amine oxide coupler is increased (ratio of coupler to organic material increases), the percent soap film and scale removed by the compositions also increases, contrary to the teachings of U.S. Pat. Nos. 5,080,822 and 5,080,831. This was a highly unexpected result.

Strong And Weak Organic Acids Useful In Soap Scale Cleaning Compositions

The preferred chemical structures of the strong and weak organic acids, and their respective aqueous pH's were given previously. In the soap scale removal compositions of the second aspect of the invention, the strong organic acid typically and preferably has a concentration ranging from about 20 to about 40 weight percent, more typically ranging from about 25 to about 35 weight percent based on total weight of concentrated composition.

The weight percentage of weak organic acid in the second aspect of the invention typically ranges from about 15 to about 30 weight percent, more preferably ranging from about 18 to about 25 weight percent, based on weight of concentrated formulation.

In the compositions of the second aspect of the invention suitable for removing soap scale from surfaces, performance is generally improved as the ratio of the weak organic acid to strong organic acid is increased. However, care must be taken not to include too much weak organic acid as the composition may be harmful to the underlying surface.

Surfactants

As previously noted, the surfactant serves the function of decreasing the surface tension of water within the diluted versions of the compositions of the invention.

Nonionic surfactants are one preferred class of surfactants useful in the hydrophobic soil removing compositions of the invention. Examples are the nonionic detergents formed by condensation of an alkyl phenol, an alkyl amine, or an aliphatic alcohol with sufficient ethylene oxide, propylene oxide, or combination thereof, to produce a compound having a polyoxyethylene and/or polyoxypropylene chain within the molecule, i.e., a chain composed of recurring ($—O—CH_2—CH_2—$) groups, or a chain composed of recurring ($—O—CH_2—CH_2—CH_2—$) groups, or combination thereof. Many compounds of this type are known and used for their detergent, surface active, wetting and emulsifying properties, such as the nonionic surfactant known under the trade designation "T-DET A-826", available from Harcros Chemical Company.

The surfactants of this type which are useful in the present invention are those produced by condensation of about 4–16, and preferably 4–12 moles of ethylene oxide (or propylene oxide, or combination thereof) with one mole of a compound selected from the group consisting of (1) an alkyl phenol having about 1–15, and preferably 7–10, carbon atoms in the alkyl group; (2) an alkyl amine having about 10–20, and preferably 12–16, carbon atoms in the alkyl group; (3) an aliphatic alcohol having about 10–20, and preferably 12–16, carbon atoms in its molecule; and (4) a hydrophobic base formed by condensing propylene oxide with propylene glycol. Mixtures of two or more of the nonionic detergent groups identified above may also be used. The number of moles of ethylene oxide (or propylene oxide) which are condensed with one mole of parent compound (i.e. the alkyl phenol, the alkyl amine, or the aliphatic alcohol) depends upon the molecular weight of the hydrophobic portion of the condensation product. The nonionic surfactant used in the invention should have sufficient ethylene oxide units (or propylene oxide units, or both) to insure solubility thereof in the composition or in any dilution thereof which may be used in practice.

In general, nonionic surfactants suitable for use in the invention can be formed by condensing the reactants in the proportions set forth above. The weight percent of the surfactant typically ranges from about 0.1 to about 1.0 weight percent in ready-to-use formulations, with amounts of surfactant greater than about 1.0 weight percent being uneconomical and not typically rendering a more beneficial wetting property. If the amount of nonionic surfactant is below about 0.1 weight percent, insufficient wetting of the hydrophobic soil-covered surface may be noticed, but this is not necessarily considered outside of the invention.

Optional Ingredients

The compositions of the invention may contain other optional but conventional additives. For example, the compositions may contain a colorant to provide a more aesthetic appearance, a fragrance to provide more acceptable smell, a preservative to prevent bacterial growth in the solution, a suitable anti-microbial agent or bacteriostat to eradicate germs, mold, mildew, and the like, foaming or anti-foaming agents, film-forming agents, and the like. Anti-microbial and bacteriostats are especially useful in the soap scale cleaning compositions of the invention. Such components are well known in the art and specific amounts of each will be within the knowledge of the artisan. One preferred anti-microbial compound is the quaternary ammonium compound known under the trade designation "BARDAC 205M", available from Lonza Chemical Company.

In use, the compositions of the invention may be sprayed as an aerosol or non-aerosol upon the surface to be cleaned, or simply poured thereon. Spraying can be accomplished by conventional mechanical spraying devices or by using an aerosol dispensing container with a sufficient amount of suitable aerosol propellant such as a low boiling alkaness or mixtures thereof, such as a mixture isobutane and propane.

Examples of particularly preferred concentrated and RTU compositions considered within the invention are presented in Table A.

TABLE A

| | Hydrophobic Soil Cleaner | | Bath Cleaner | |
|---|---|---|---|---|
| Ingredient | Conc. | Dilute | Conc. | Dilute |
| T-Det A-826 (nonionic surfactant) | 22.3 | 0.223 | — | — |
| MEA | 33.3 | 0.333 | — | — |
| dodecylbenzene sulfonic acid | 22.2 | 0.222 | — | — |
| NOP | 22.2 | 0.222 | 31.0 | 0.775 |
| AMMONYX LO (amine oxide) | — | — | 10.0 | 0.250 |
| glycolic acid | — | — | 29.5 | 0.7375 |
| acetic acid | — | — | 20.0 | 0.50 |
| Bordac 205M (disinfectant) | — | — | 8.0 | 0.20 |
| Dye/Fragrance | — | — | balance | |
| Water | — | 99.0 | | |

Methods Of Cleaning Surfaces Using The Compositions Of The Invention

The compositions of the invention may be applied to surfaces in concentrated or ready-to-use form as desired. Although scrubbing is preferably not required to remove hydrophobic soils or soap scum and scale using the compositions of the present invention, especially if the underlying surface is soft and/or decorative, an abrasive article may be used, such as a porous sponge material, or nonwoven or woven article. One preferred nonwoven material is that known under the trade designation "Scotch-Brite", from Minnesota Mining and Manufacturing Company ("3M"), St. Paul, Minn. Such nonwoven products and their manufacture are described in U.S. Pat. No. 2,958,593 (Hoover et al.).

The compositions and methods of the invention are further described in the following Test Methods and Examples, wherein all parts and percentages are by weight unless otherwise specified.

TEST METHODS

Test Method 1: Food Grease Removal Test

In the food grease removal tests, a standard food grease solution consisting of equal amounts of soy bean oil and lard dissolved in enough methylene chloride to form a solution was prepared. A small amount of oil blue pigment was added to the solution. 25 millimeter (mm)×75 mm glass slides were then immersed for a few seconds into the food grease and drawn up quickly so that the food grease coated both sides of the slide (25 mm×30 mm on each side). The food grease-coated slides were then dried by hanging at room temperature (about 20° C.) for at least 16 hours.

In the food grease removal test, 140 milliliters (ml) of composition to be tested was placed into a 150 ml glass beaker equipped with a magnetic stir bar (2.54 cm in length). The beaker was then placed on a magnetic stirrer (Barnant Co. model no. 700-5011). The coated glass slide to be cleaned was then suspended vertically in the composition to be tested, coated portion pointing toward the bottom of the beaker with the other end attached to a suitable support, so that the glass slide did not touch anything but the composition being tested, and the stir bar did not hit the glass slide or the sides of the beaker. The magnetic stirrer was immediately turned on and the stirring power adjusted to 2000 rpm with a strobe light. The composition was stirred for five minutes, after which the % removal of food grease was measured visually for each side of the slide. Slides were not reused.

Test Method 2: Soap Scum Removal Test

In this test, a standard soap scum-forming composition was prepared consisting of a soap solution, graphite powder, sebum, and "hard" water. (A synthetic hard water was prepared by dissolving small portions of calcium and magnesium in deionized water with mild heating. This was then mixed with the graphite, sebum, and soap solution to prepare the standard soap scum forming composition.) The standard soap scum-forming composition was then sprayed onto black ceramic tiles, and then let dry overnight (about 12 hours) to form a standard soap scum.

A Gardner abrasion tester, available from Pacific Scientific Co., was then used to try to remove the soap scum from the ceramic tiles. This machine essentially comprised a horizontal surface to which the standard soap scum-coated panels were attached, and a reciprocating holder for a nonwoven surface treating article. A nonwoven pad (trade designation "Scotch-Brite" 9030, from 3M) was attached to the reciprocating holder so that the pad rubbed across the standard soap scum-coated ceramic tile. The weight of the holder was approximately 300 grams. The machine was run for 10 cycles thus removing at least a portion of the standard soap scum from the coated ceramic tile. After 10 cycles the amount of soap scum removed was measured visually. The ceramic tiles were not reused.

Materials Description

"SURFADONE" LP-100 is the trade designation for N-octyl pyrrolidone, available from International Specialty Products, Wayne, N.J.;

"SURFADONE" LP-300 is a trade designation for N-dodecyl pyrrolidone, available from International Specialty Products, Wayne, N.J.;

"MEA" is a designation for monoethanolamine, available from Union Carbide Corporation, New York, N.Y.;

"T-DET A-826" is a trade designation for a linear alcohol alkoxylate nonionic surfactant, available from Harcros Chemical Company;

"SDS" is sodium dodecylbenzenesulfonic acid;

"AMMONYX LO" is a trade designation for an amine oxide coupler, available from Stepan Chemical Company , Northfield, Ill.;

"BARDAC 205M" is a trade designation for a quaternary ammonium compound which is useful as an antimicrobial agent, available from Lonza Chemical Company.

EXAMPLES

Examples 1–4: Food Grease Removal

The compositions of Examples 1–4 are provided in Table 1. All compositions of Examples 1–4 have more than 3 times the minimum amount of coupler required to completely solubilize the very slightly water-soluble organic material. These compositions were subjected to the Food Grease Removal Test described above. The time for complete removal of the food grease is given in Table 1. The data in Table 1 verify that an increase in sodium dodecylbenzenesulfonic acid, a known coupler, beyond 3 times that required to completely solubilize the very slightly water-soluble organic solvent improved the cleaning performance of the composition.

TABLE 1

| Ingredient | Ex. 1 (Wt %) | Ex. 2 (Wt %) | Ex. 3 (Wt %) | Ex. 4 (Wt %) |
|---|---|---|---|---|
| SURFADONE LP-100 | 0.5 | 0.5 | 0.5 | 0.5 |
| MEA | 0.75 | 0.75 | 0.75 | 0.75 |
| T-DET A-826 | 0.5 | 0.5 | 0.5 | 0.5 |
| SDS | 0.2 | 0.3 | 0.4 | 0.5 |
| Water | 98.05 | 97.95 | 97.85 | 97.75 |
| Coupler Amount[1] | ~21.1 | 23.3 | 25.5 | 27.8 |
| Time for Removal (Min:Sec) | 5:31 | 5:24 | 4:38 | 4:08 |

[1]In other words, "20x" means 20 times that required to completely solubilize the Surfadone LP-100

Example 5 And Comparative Examples A and B: Soap Scum Removal

The concentrated compositions of Example 5 and Comparative Examples A and B are provided in Table 2. Example 5 had more than 3 times the minimum amount of coupler required to completely solubilize the very slightly water-soluble organic material. However, Comparative Examples A and B had less than 3 times the minimum amount necessary to completely solubilize the very slightly water-soluble organic material.

These compositions, after diluting with water (39 parts water to 1 part concentrated composition) were subjected to the Soap Scum Removal Test described above. The amount of soap scum removed is given in Table 2 for each composition tested. These data verify that a decrease in amine oxide coupler (AMMONYX LO) below 3 times that required to completely solubilize the very slightly water-soluble organic solvent decreased the cleaning performance of the composition.

TABLE 2*

| Ingredient | Ex. 5 (Wt %) | Compar. Ex. A (Wt %) | Compar. Ex. B (Wt %) |
|---|---|---|---|
| SURFADONE LP-100 | 31.0 | 31.0 | 31.0 |
| AMMONYX LO | 10.0 | 5.0 | 3.0 |
| Glycolic Acid | 29.5 | 29.5 | 29.5 |
| Acetic Acid | 20.0 | 20.0 | 20.0 |
| BARDAC 205M | 8.0 | 8.0 | 8.0 |
| Dye/Fragrance/water | Balance | Balance | Balance |
| % Soap Scum Removal | 40 | 30 | 25 |

*Concentrates, diluted 39 parts water to 1 part concentrate for testing

Various modifications of the invention will be apparent to those skilled in the art. The examples and description are intended to support and enable the following claims, and are not intended to limit the scope thereof.

What is claimed is:

1. A composition suitable for removing soap scum and mineral scale as may be found in household bathrooms, the composition comprising:

a) an organic solvent having a surface tension of no more than about 30 dynes/cm at 0.1 weight percent in water, and which is very slightly water-soluble;

b) an amine oxide coupler present at a concentration of at least 3 times the amount required to completely solubilize the organic solvent (as observed visually with no magnification);

c) a strong organic acid; and d) a weak organic acid;

wherein the soap scum removal rate improves when the amine oxide coupler is present at a weight which is at least three times that weight required to completely solubilize the organic solvent.

2. Composition in accordance with claim 1 wherein said organic solvent is selected from the group consisting of N-alkyl pyrrolidones wherein the alkyl group has from about 8 to about 12 carbon atoms.

3. Composition in accordance with claim 2 wherein the N-alkyl pyrrolidone is N-octyl pyrrolidone.

4. Composition in accordance with claim 1 wherein said strong organic acid is selected from the group consisting of acids within the general formula $R^4COOH$, where $R^4$ is selected from the group consisting of $C_2$–$C_{20}$ hydroxyalkyl groups and alkyl groups.

5. Composition in accordance with claim 4 wherein said strong organic acid is hydroxyacetic acid.

6. Composition in accordance with claim 1 wherein said weak organic acid is selected from the group consisting of organic acids within the general formula $R^5COOH$, wherein $R^5$ is selected from the group consisting of $C_1$–$C_5$ alkyl groups.

7. Composition in accordance with claim 6 wherein said weak organic acid is acetic acid.

8. Composition in accordance with claim 1 wherein said coupler is selected from amine oxides represented by the general formula:

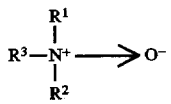

wherein $R^1$, $R^2$, and $R^3$ are defined as follows:

$R^1$ and $R^2$ may be the same or different and selected from the group consisting of $C_1$–$C_4$ alkyl or hydroxyalkyl groups; and $R^3$ is selected from the group consisting of $C_8$–$C_{20}$ straight or branched chain alkyl or heteroalkyl groups.

9. Composition in accordance with claim 1 wherein the very slightly water-soluble organic solvent and said amine oxide coupler are present in a weight ratio ranging from about 2:1 to about 5:1.

10. Composition in accordance with claim 1 wherein said strong organic acid and said weak organic acid are present in a weight ratio ranging from about 1:1 to about 2:1.

11. Composition in accordance with claim 1 wherein the very slightly water-soluble organic solvent and said weak organic acid are present in a weight ratio ranging from about 1.0:1.0 to about 2.0:1.0.

12. A method of removing soap scum and scale from hard surfaces comprising applying to the hard surface an effective amount of the composition of claim 1.

13. Method in accordance with claim 12 which comprises abrading the surface with an abrasive article after the composition has been applied to the surface.

14. Method in accordance with claim 13 wherein the abrasive article is a nonwoven abrasive article.

15. Method in accordance with claim 14 wherein after abrading with the abrasive article the surface is wiped with a nonabrasive material.

16. A composition suitable for removing soap scum and mineral scale as may be found in household bathrooms, the composition comprising:

a) an organic solvent selected from the group consisting of an N-alkyl pyrrolidone wherein the alkyl group has from about 8 to about 12 carbon atoms;

b) an amine oxide coupler present at a concentration of at least 3 times the amount required to completely solubilize the organic solvent;

c) a strong organic acid selected from the group consisting of an organic acid having the formula $R^4COOH$, wherein $R^4$ is selected from the group consisting of $C_2$–$C_{20}$ straight or branched hydroxyalkyl and alkyl groups; and d) a weak organic acid selected from the group consisting of an organic acid having the formula $R^5COOH$, wherein $R^5$ is selected from the group consisting of $C_1$–$C_5$ alkyl groups, wherein the cleaning performance of the composition improves as the concentration of the coupler increases.

* * * * *